US005314559A

United States Patent [19]

Rinehart et al.

[11] Patent Number: 5,314,559

[45] Date of Patent: May 24, 1994

[54] APPARATUS FOR APPLYING GLUE TO CLOSURE STAMPS FOR INSERTION ONTO PACKAGES

[75] Inventors: Steven R. Rinehart, Chesterfield; James W. Giles, Jr., Petersburg; Charles P. Pendleton, Madison Heights; Marvin M. Grimsley, Mosely, all of Va.

[73] Assignee: Philip Morris Incorporated, New York, N.Y.

[21] Appl. No.: 952,257

[22] Filed: Sep. 28, 1992

[51] Int. Cl.[5] ..... B32B 31/00

[52] U.S. Cl. ..... 156/356; 118/212; 118/695; 156/548; 156/556; 156/578

[58] Field of Search ..... 156/548, 290, 547, 356, 156/291, 578, 556; 118/211, 212, 695

[56] References Cited

U.S. PATENT DOCUMENTS

| | | | |
|---|---|---|---|
| 768,734 | 8/1904 | Clark | 118/212 |
| 1,986,039 | 1/1935 | Ackley | 118/212 |
| 2,257,465 | 9/1941 | Higginbottom | 93/8 |
| 2,776,224 | 1/1957 | Cote | 118/212 |
| 2,958,437 | 11/1960 | Mengis | 156/548 |
| 3,023,128 | 2/1962 | Affelder | 118/212 |
| 3,030,915 | 4/1962 | Shannon | 118/212 |
| 3,948,115 | 4/1976 | Seragnoli | 53/154 |
| 3,987,753 | 10/1976 | Seragnoli | 118/212 |
| 4,053,056 | 10/1977 | Day | 53/53 |
| 4,166,246 | 8/1979 | Matt | 328/5 |
| 4,175,456 | 11/1979 | Seragnoli | 83/176 |
| 4,411,217 | 10/1983 | Valenti | 118/212 |
| 4,546,011 | 10/1985 | Wolfrum | 118/211 |
| 4,562,692 | 1/1986 | Scarpa et al. | 53/566 |
| 4,710,257 | 12/1987 | Mattei et al. | 156/578 |

FOREIGN PATENT DOCUMENTS

| | | | |
|---|---|---|---|
| 344612 | 10/1978 | Austria | B65B 51/02 |
| 118824 | 12/1899 | Fed. Rep. of Germany . | |
| 2195925A | 7/1987 | United Kingdom | B05C 1/02 |

*Primary Examiner*—David A. Simmons
*Assistant Examiner*—William J. Matney, Jr.
*Attorney, Agent, or Firm*—Burns, Doane, Swecker & Mathis

[57] ABSTRACT

An apparatus applies glue to closure stamps for insertion onto packages, such as cigarette packs. A pair of rotatable glue-applying wheels receive glue from a glue pot and transfer the glue onto the backs of the closure stamps as the closure stamps are fed therepast. A portion of the peripheral edge of each glue-applying wheel is recessed radially inwardly, to define an interruption in an outer diameter of the peripheral edge, so that only a non-recessed portion of the outer edge transfers glue to the closure stamps. In this way, opposite ends of the glue lines are spaced from leading and trailing edges of the closure stamp. A synchronizing mechanism is provided to achieve a proper synchronization between the stamp-feeding mechanism and the glue-applying wheels to ensure that the glue lines are kept spaced from the leading and trailing ends of the closure stamp.

5 Claims, 3 Drawing Sheets

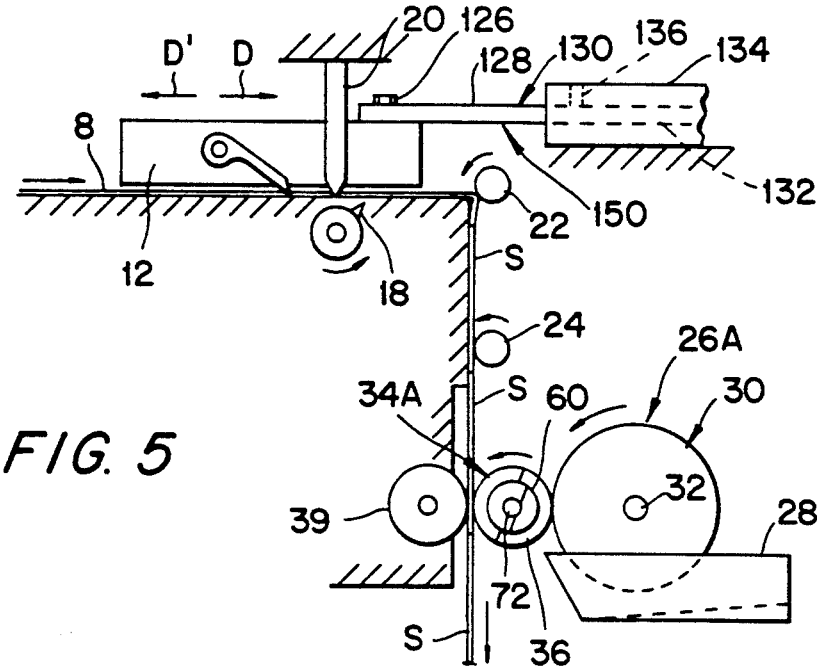
FIG. 5
FIG. 6
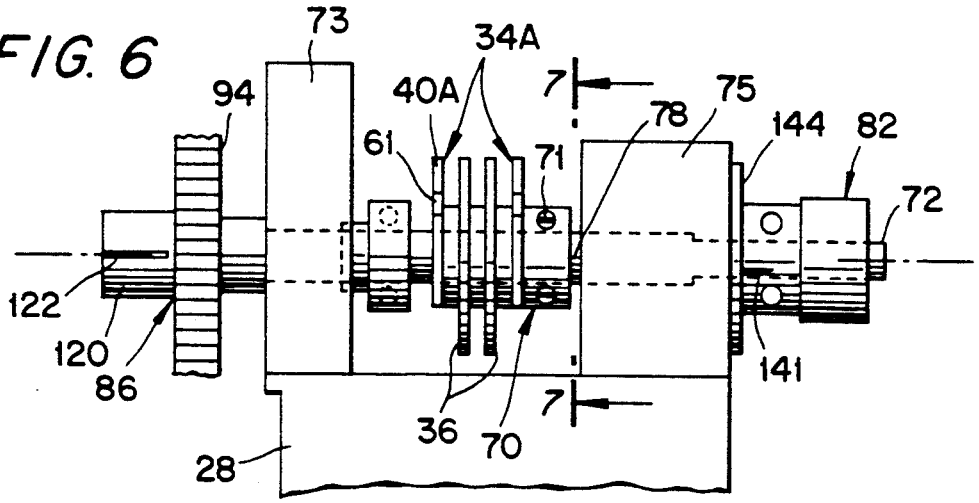
FIG. 7
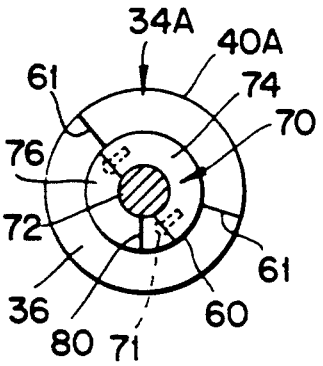
FIG. 8
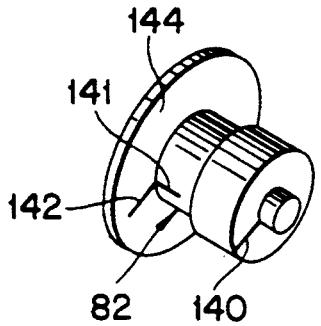
FIG. 9
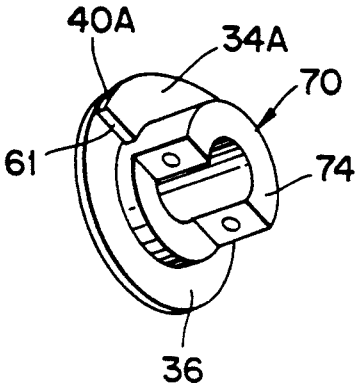

FIG. 10
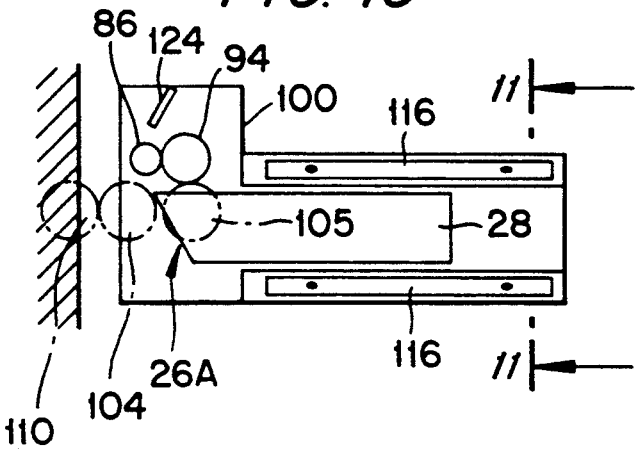
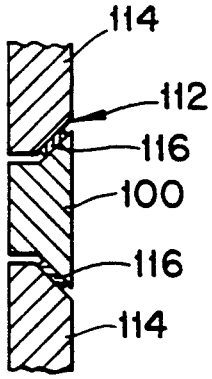
FIG. 11
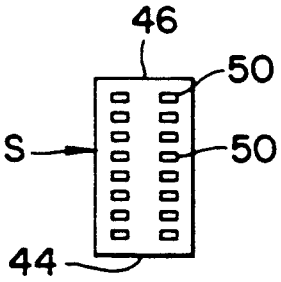
FIG. 12
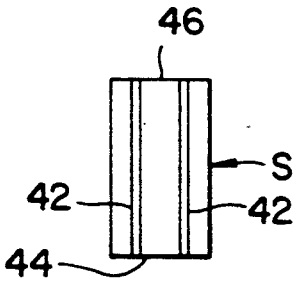
FIG. 13
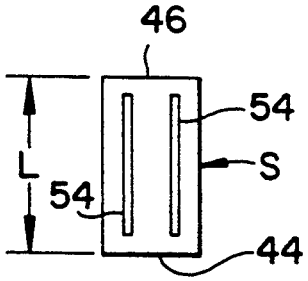
FIG. 14

APPARATUS FOR APPLYING GLUE TO CLOSURE STAMPS FOR INSERTION ONTO PACKAGES

BACKGROUND OF THE INVENTION

The present invention relates to the application of glue to closure stamps for insertion onto packages such as cigarette packs.

The packaging of cigarettes is performed mechanically by means of machines which sequentially deposit tobacco onto sheets of cigarette paper, roll the sheets into cigarette form, insert the cigarettes into a package, seal the package, and apply closure stamps to the package. Machines of this type are manufactured, for example, by G.D. Societa per Azioni, Italy.

In that machine, the glue is applied to each closure stamp by two thin rotary wheels. As the wheels are rotated about a common axis, the outer edges of the wheels pick up glue from the glue pot and then apply the glue to the stamp. Hence, there are formed on the back of the stamp two spaced-apart, parallel lines of glue which extend from a leading edge of the stamp to a trailing edge thereof.

When the stamp is applied to a package, there is a tendency for some of the glue to emerge from the edges of the stamp, and thereby mar the appearance of the package. Mechanisms have been proposed for alleviating that problem, e.g., by spacing the ends of each glue line from the respective edges of the stamp. For example, a glue-applying wheel is provided along its outer edge with a plurality of circumferentially spaced, axially extending grooves. Each groove forms a pocket that picks-up glue from a glue source as the wheel rotates. A scraper engages the peripheral edge of the wheel to scrape off all glue except the glue situated in the pockets. The wheel continues to rotate, whereupon the pockets come into contact with a stamp in order to transfer daubs of glue from the pockets to the stamp. The pockets occupy a circumferential portion of the wheel edge sufficient to ensure that the ends of the glue lines are spaced from the respective leading and trailing edges of the stamp. There exists a risk, however, of the glue becoming dried in the pockets, thereby inhibiting a proper depositing of glue on the stamp.

It would be desirable to minimize that risk while ensuring that the glue lines are spaced from the stamp edges by means of relatively simple modifications to a conventional glue-applying mechanism.

SUMMARY OF THE INVENTION

The present invention relates to an apparatus for applying glue to closure stamps for insertion onto packages, such as cigarette packs. The apparatus comprises a source of glue and at least one rotatable glue-applying wheel positioned at a glue-applying zone such that a peripheral edge thereof receives glue from the glue source as the glue-applying wheel rotates. A drive mechanism rotates the glue-applying wheel. A feeding mechanism advances the row of closure stamps sequentially through the glue-applying zone and into contact with the peripheral edge of the glue-applying wheel to receive therefrom a line of glue extending in a direction of travel of the closure stamps through the glue-applying zone. A portion of the peripheral edge of the glue-applying wheel is recessed radially inwardly to define an interruption in an outer diameter of that peripheral edge so that only a non-recessed portion of the outer edge transfers glue to the closure stamp. The non-recessed portion has a circumferential length shorter than a distance separating leading and trailing edges of each closure stamp, so that opposite ends of the glue lines are spaced from the leading and trailing edges, respectively.

Preferably, the drive mechanism is connected to the feeding mechanism for actuating the latter. The glue-applying wheel is disconnectible from the drive mechanism. A synchronizing mechanism is provided for synchronizing the rotary position of the glue-applying wheel relative to the linear position of the feeding mechanism upon reconnection of the drive mechanism with the groove-applying wheel, to ensure that the ends of the glue line are spaced from the leading and trailing ends of the closure stamps.

The synchronizing mechanism preferably comprises first and second reference-defining elements driven synchronously with the glue-applying wheel and the feeding mechanism, respectively. First and second sensing elements are provided for sensing the positions of the first and second reference-defining elements, respectively, and providing first and second signals in accordance with such sensing positions. A manual actuating element is provided for displacing either the feeding mechanism or the glue-applying wheel relative to each other in order to achieve a synchronized relationship therebetween.

Closure stamps may be supplied initially as a strip of interconnected closure stamps. In that case, the apparatus would include a cutter for separating closure stamps from the strip. The cutter would be connected to the drive mechanism such that the synchronizing mechanism synchronizes the rotary position of the glue-applying wheel with both the feeding mechanism and the cutter.

BRIEF DESCRIPTION OF THE DRAWINGS

The objects and advantages of the invention will become apparent from the following detailed description of a preferred embodiment thereof in connection with the accompanying drawings in which like numerals designate like elements and in which:

FIG. 5 is a view similar to FIG. 3 of a stamp-applying station according to the present invention;

FIG. 6 is a front elevational view of a glue-applying unit as seen by a stamp to which glue is being applied;

FIG. 7 is a sectional view taken along the line 7—7 in FIG. 6;

FIG. 8 is a perspective view of a manual actuating knob according to the present invention;

FIG. 9 is a perspective view of a portion of the glue-applying wheel unit depicted in FIGS. 6 and 7;

FIG. 10 is a schematic side elevational view of a slide which carries the glue-applying unit according to the present invention;

FIG. 11 is a sectional view taken along the line 11—11 in FIG. 10 and including a track-defining frame;

FIG. 12 is a view of a back of a closure stamp which has been glued in accordance with one prior art technique;

FIG. 13 is a view of the back side of a closure stamp which has been glued in accordance with another prior art technique; and FIG. 14 is a view of the backside of a closure stamp which has been glued in accordance with the present invention.

DETAILED DESCRIPTION OF A PREFERRED EMBODIMENT OF THE INVENTION

Figure 1:
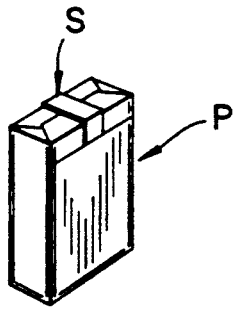
FIG. 1 (PRIOR ART)
FIG. 1 is a perspective view of a cigarette pack having a conventional closure stamp thereon.
Figure 2:
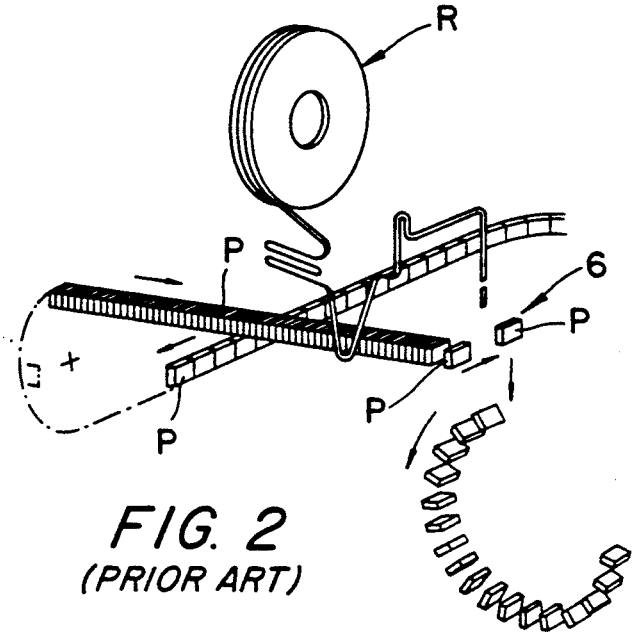
FIG. 2 (PRIOR ART)
FIG. 2 is a perspective schematic view of cigarette packs being fed to a stamp-applying station in a conventional manner.

A conventional cigarette packaging machine forms cigarettes, inserts them into a pack, and applies closure stamps sequentially to the packs. FIG. 1 depicts a cigarette pack P having a closure stamp S thereon. FIG. 2 depicts packs P being conveyed to a station 6 where the closure stamps are applied.

The closure stamps S may be supplied in continuous strip form from a reel R as shown in FIG. 2. Alternatively, the stamps could be provided as a stack of pre-cut strips (not shown). In either case, the stamps are advanced toward the stamp-applying station 6 where the backsides of the stamps are provided with glue prior to being pressed onto the pack.

Figure 3:
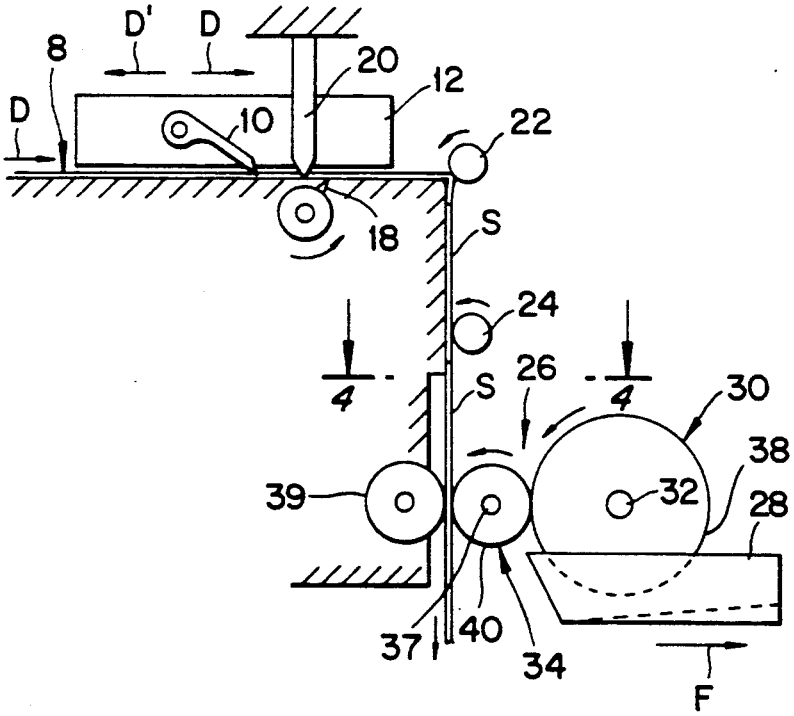
FIG. 3 (PRIOR ART)
FIG. 3 is a schematic side elevational view of a conventional stamp-applying station.

Shown schematically in FIG. 3 is a continuous strip 8 of stamps S being advanced in a forward direction D. Advancement is performed by a drive finger 10 carried by a strip-feeding slide 12. The drive is reciprocated in direction D-D' by a suitable drive mechanism (not shown). A front edge of the drive finger 10 engages pre-cut slits formed in the strip 8, the slits extending transversely of the direction D. Thus, by moving the strip-feeding slide forwardly in direction D, the finger advances the strip 8. At the end of the forward stroke of the strip-feeding slide 12, the finger 10 is rotated (counterclockwise in FIG. 3) to raise the front edge thereof, whereupon the strip-feeding slide is slid rearwardly in direction D' so that the finger can engage a subsequent slit.

As the strip is advanced, a rotary knife 18 severs the strip 8 at the slits. An anvil 20 opposes the knife 18 at the cutting zone to enable the knife to cut through the strip. Upon being cut the closure stamps S are engaged by driven rollers 22, 24 which advance the stamps S downwardly to a glue-applying unit 26.

Figure 4:
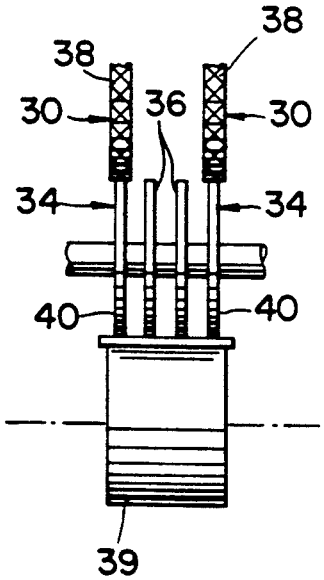
FIG. 4 (PRIOR ART)
FIG. 4 is a sectional view taken along the line 4—4 in FIG. 3.

The glue-applying unit 26 comprises a glue pot 28 in which a pair of glue pick-up wheels 30 (see FIGS. 3 and 4) are rotated about a common axle 32. Mounted to the glue pot in front of the pick-up wheels 30 is a row of driven wheels comprising a pair of glue applying wheels 34 and, disposed between the glue-applying wheels 34, a pair of stamp-driving wheels 36. Those wheels 34, 36 are affixed to a drive shaft 37. The stamp-driving wheels 36 engage each stamp S and advance it downwardly. A back-up roller 39 (or a plurality of back-up rollers) oppose the wheels 34, 36. When it becomes necessary to retract the glue-applying unit 26 from the stamp path, e.g, in order to clean the glue pot, the unit 26 can be slid in a direction F away from the back-up roller 39 in a manner to be described later herein.

The glue pick-up wheels 36 have knurled peripheral edges 38 which promote the pick-up of glue from a pool of glue in the glue pot. That glue is then transferred to the peripheral edges 40 of the glue-applying wheels 34. The glue-applying wheels 34 then transfer the glue onto the backsides of the stamps S. Thus, as depicted in FIG. 13, each stamp S is provided with two continuous parallel glue lines 42 extending from a leading edge 44 to a trailing edge 46 of the stamp.

Then, the stamps S are pressed onto respective cigarette packs P. In so doing, it may occur that some of the glue is pressed out from behind the stamp and becomes visible, thereby marring the appearance of the pack.

As described earlier herein, it has been proposed to form each glue line as a row of parallel daubs 50 (see FIG. 12) extending parallel to the leading and trailing edges 44, 46 of the stamp, each row terminating inwardly from the leading and trailing edges. The glue-applying mechanism for achieving that result is radically different from (and more expensive than) that depicted in FIG. 3 in that the designs of the glue pot and glue-applying wheels are considerably changed, and the stamps are fed by a vacuum wheel.

In accordance with the present invention, two continuous glue lines 54 are applied to the stamp, each glue line terminating inwardly from the leading and trailing edges 44, 46 of the stamps as depicted in FIG. 14. Moreover, this is achieved without having to radically redesign the conventional glue-applying unit 26. Rather, that unit is modified in manner enabling its basic structure and operation to remain the same.

Attention is directed to FIGS. 5 and 7 which show a glue-applying unit 26A according to the present invention. That unit includes glue-applying wheels 34A that have been modified over the previously described conventional wheels 34 by providing the peripheral edge 40A of each wheel 34A with a radial inward recess 60 having radial shoulders 61. The recess forms an interruption in the outer diameter of that edge. The circumferential length of the non-recessed portion is shorter than the length L of the stamp S. It will thus be appreciated that as the glue-applying wheels 34A and the glue pick-up wheels 30 rotate, no glue will be applied to the recessed portion of the peripheral edges 40A of the glue-applying wheels 34A. Accordingly, the glue lines will no longer be applied continuously on the stamps S, but rather will be periodically interrupted. By properly synchronizing the rotation of the glue-applying wheels 34A relative to the feeding of stamps S, the interruptions in the glue lines can be made to occur such that the ends of the glue lines are spaced from the leading and trailing edges 44, 46 of each stamp, as shown in FIG. 14. The means of achieving that synchronization will be described later herein.

The glue-applying wheels 34A and stamp driving wheels 36 according to the present invention are depicted in FIG. 6 as "seen" by a stamp. The wheels 34A, 36 are formed of one-piece with a hub 70 (see FIGS. 7 and 9) which is clamped to a drive shaft 72. The drive shaft is rotatably mounted in flanges 73, 75 of the glue pot 28. The wheels and hub form a wheel unit. The hub includes semi-cylindrical sections 74, 76 (only the section 74 being depicted in FIG. 9) which are secured together by screws 71 to clamp the hub to the drive shaft. The drive shaft 72 includes a longitudinal reference line 78 (see FIG. 6), and the hub includes a radial reference mark 80 (see FIG. 7). When connecting the wheel unit 71 to the drive shaft 72, the wheel unit is rotated relative to the shaft 72 until the reference mark 80 points to (i.e., intersects) the reference line 78. Then, the hub is clamped to the shaft 72 by the screws 71.

Mounted fixedly on one end of the shaft 72 is a manual turning knob 82, and mounted fixedly on the other end of the shaft 72 is a gear 86. Teeth of the gear 86 mesh with the teeth of a gear 94 which is attached to the shaft 32 on which the glue pick-up wheels are mounted. Hence, by driving the gear 94 the glue pick-up wheels 30, glue-applying wheels 34A, and stamp feeding wheels 36 will be driven.

The glue-applying unit 26A is mounted on a conventional slide 100 shown schematically in FIG. 10. The slide carries gears 104, 105 which connect the gear 94 with a drive gear 110 that is mounted on the machine frame. The drive gear 110 is connected to the main drive train to rotate the wheels 30, 34A, and 36 when the gears 110, 104 are in mesh. By sliding the slide 100 away from the gear 110 (i.e., to the right in FIG. 10), the gears 104, 110 are moved out of mesh to terminate rotation of the wheels. Sliding of the slide is performed manually by an operator in a conventional manner, e.g., by means of a lever (not shown) connected to the slide by a rack and pinion coupling. When the unit 26A is retracted, it is conventional to cause one of the gears 104, 105, 94 to come into engagement with an auxiliary electrically driven drive gear (not shown) to keep the glue-pick-up wheels 30 and glue-applying wheels 34A rotating in order to prevent the glue thereon from drying out.

The slide 100 slides along a guide track 112 on the machine frame shown in FIG. 11. The slide 100, the gears 104, 105, and the guide track 112 are conventional. However, in accordance with the present invention, the slide carries upper and lower wear strips 116 formed of stainless steel so as to be highly resistant to wear. A conventional slide formed of a softer material was susceptible to wear. Such wear could result in a displacement of the glue-applying unit out of its proper orientation relative to the stamps. That shortcoming is eliminated by the wear strips 116 which can be fastened to the slide 100 in any suitable fashion, such as by screws.

As observed above, the drive gear 110 is connected to the main drive train. That drive train is also connected to the strip feeding slide 12 and the knife 18. The drive relationship between the glue-applying wheels 34A and the strip-feeding slide 12 (and knife 18) is such that if a properly synchronized relationship exists therebetween, that synchronized relationship will be maintained during the operation of the machine. By "properly synchronized" relationship is meant a relationship wherein the ends of the glue lines 54 applied to the stamps are properly spaced from the leading and trailing edges 44, 46 of the stamps as shown in FIG. 14.

It will be appreciated that whenever the glue-applying unit 26A is retracted to disengage the gears 110, 104, and thereafter is slid forwardly to re-engage those gears, the rotary position of the glue-applying wheels 34A relative to the linear position of the strip-feeding slide 12 will likely be changed, thereby destroying the synchronous relationship therebetween. Accordingly, the present invention includes a mechanism for enabling an operator to conveniently reestablish that synchronous relationship.

In that regard, the gear 86 includes a hub 120 having a reference line defined by a slot 122 (see FIG. 6). Hence, the hub 120 constitutes a reference member which rotates simultaneously with the glue-applying wheels 34A. A photo electric sensor, such as a fiber optic cable based sensor 124, is mounted on the slide 100 (see FIG. 9) and positioned to sense the reference line 122 and provide a signal, such as the illumination of an indicator lamp (not shown). When that lamp is illuminated, it is known that the peripheral edges 40A of the glue-applying wheels 34A are in a certain predetermined rotary orientation (assuming that the reference lines 78, 80 are properly aligned).

Attached to the strip-feeding slide 12 by a bolt 126 is an arm 128 which contains a reference line 130 (see FIG. 5). The arm 128 reciprocates simultaneously with the strip-feeding slide and is received loosely within a recess 132 of a stationary block 134. Mounted in the block 134 is a fiber optic cable based photo-electric sensor 136 positioned to sense the reference line 130 and provide a signal such as the illumination of an indicator lamp (not shown). Hence, when both indicator lamps connected to the sensors 124, 136 are illuminated, an operator knows that the properly synchronized relationship exists.

The operator can adjust the relationship between the glue-applying wheels 34A and the stamp-feeding slide 12 whenever the glue-applying unit 26A is in its retracted position by (a) rotating a conventional manual hand wheel (not shown) connected to the drive train for actuating the stamp-feeding slide 12, and (b) rotating the manual knob 82 attached to the drive shaft 72 of the glue-applying wheels 34A. Therefore, before the operator slides the slide 100 from its retracted position to its operable position, the operator first rotates a hand wheel until an indicator lamp is illuminated to indicate that the reference line 130 has been sensed by the sensor 136. Then, it is necessary to position the drive shaft 72 such that the reference line 122 will be sensed by the sensor 124. This is performed by manually rotating the knob 82. To facilitate this operation, timing lines 140, 141 are provided on the knob 82. (This is performed subsequent to moving the slide slightly toward the operable position to uncouple the gears of the slide with the afore-mentioned auxiliary electrically driven drive wheel (not shown) which had kept the glue pick-up and glue-applying wheels rotating.) Those reference lines 140, 141 can be brought into alignment with a timing line 142 formed on a stationary timing wheel 144 mounted on the side of the glue pot 28 (see FIG. 8). Once the operator has, by visible inspection, determined that the timing line 142 is aligned with reference lines 140 and 141 of the knob 82, he/she manually rotates a lever to slide the slide 100 (and thus the glue-applying unit 26A) into the operable position, whereupon the indictor lamp connected to the sensor 124 should become illuminated. If not, then the operator slides the slide to its inoperable position and realigns the timing lines and then returns the slide to the operable position.

In accordance with the present invention, a conventional glue-applying mechanism can be easily modified to enable the ends of the glue lines to be spaced from the leading and trailing edges of the stamps. It is merely necessary to provide the glue-applying wheels with recessed edge portions, and provide the conventional components of the machine with reference lines to enable a properly synchronized relationship to be established between the glue-applying wheels and the stamp-feeding slide.

It should also be noted that the machine can be provided with a conventional attachment for enabling pre-cut closure stamps to be fed (in lieu of a continuous strip). That attachment (not shown) includes a magazine which contains a vertical stack of pre-cut stamps. When such an attachment is used, the advancing function previously performed by the finger is replaced by a different mechanism which is also operably connected to the stamp-feeding slide 12. Hence, the arm 128 is still used as a position-referencing element. However, the length of the stroke of the stamp-feeding slide 12 changes when the pre-cut stamp attachment is used. Hence, it is necessary to reposition the location of the reference mark relative to the stamp-feeding slide 12. This could be accomplished by adjusting the arm to the right or left relative to the stamp-feeding slide, but preferably is accomplished by providing an alternative reference mark 150 (see FIG. 5) on the underside of the arm 128, so that it is only necessary to invert the arm on the slide.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. Apparatus for applying glue to closure stamps for insertion onto cigarette packs, comprising:

means for supplying cigarette packs for receiving closure stamps;

feeding means including a reciprocable member for advancing a row of closure stamps sequentially through a glue-applying zone;

drive means for reciprocating said reciprocable member;

a glue pot disposed in the glue-applying zone;

glue-transfer means for transferring glue from the glue pot to the closure stamps comprising:

a rotatable shaft disposed adjacent the glue pot, and connectible to said drive means to be rotated thereby;

at least one glue-applying wheel affixed to the shaft for rotation therewith and positioned such that a peripheral edge thereof receives and transfers a line of glue to the closure stamps as the closure stamps pass through the glue-applying zone, a portion of the peripheral edge of said glue-applying wheel being recessed radially inwardly to define an interruption in an outer diameter of the peripheral edge so that only a non-recessed portion of the outer edge transfers glue to the closure stamps, the non-recessed portion having a circumferential length shorter than a distance separating leading and trailing edges of each closure stamp, so that opposite ends of the glue line are spaced from the leading and trailing edges, respectively;

the glue pot being manually movable between a glue-applying position in which the shaft is in driven connection with the drive means, and a retracted position in which the shaft is out of driven connection with the drive means, the shaft being manually rotatable when the glue pot is in the retracted position, synchronizing means for synchronizing the position of the glue-applying wheel relative to the position of the reciprocable member upon reconnection of the drive means with the glue-applying wheel, to ensure that the ends of the glue line are spaced from the leading and trailing ends of the closure stamps, the synchronizing means comprising:

a first reference mark rotatable with the shaft, a first sensor for sensing the first reference mark when the latter is in a predetermined position and providing a first signal in response thereto, a second reference mark reciprocable with the reciprocable member, and a second sensor for sensing the second reference mark when the latter is in predetermined position and providing a second signal in response thereto, so that movement of the glue pot into the glue-applying position when both of the first and second signals are provided ensures that the glue-applying wheel and the reciprocable member are properly synchronized.

2. Apparatus according to claim 1 including a knob attached to the shaft enabling the shaft to be manually rotated when the glue pot is in the retracted position, the knob carrying a third reference mark which aligns with a fourth reference mark on a stationary element whenever the first reference mark is in the first predetermined position.

3. Apparatus according to claim 1 including an arm mounted to the reciprocable member for reciprocation therewith, the second reference mark being disposed on one side of the arm, an additional reference mark disposed on another side of the arm, the arm being adjustable to position the additional reference mark for being sensed by the second sensor to change the synchronization between the glue-applying wheel and the reciprocable member.

4. Apparatus according to claim 1 including a slide on which the glue pot is mounted for movement between the glue-applying and retracted positions, the slide being slidable along a track and carrying replaceable wear strips engageable with the track, the wear strips formed of a wear-resistant material.

5. Apparatus according to claim 1, wherein the glue transfer means comprises at least one glue pickup wheel arranged such that its outer periphery extends into glue carried by the glue pot and transfers glue from the glue pot the to glue-applying wheel.

* * * * *